US008342991B2

(12) United States Patent
Spector

(10) Patent No.: US 8,342,991 B2
(45) Date of Patent: Jan. 1, 2013

(54) INFLATABLE PLAY BALL

(76) Inventor: Donald Spector, New York, NY (US)

( * ) Notice: Subject to any disclaimer, the term of this patent is extended or adjusted under 35 U.S.C. 154(b) by 249 days.

(21) Appl. No.: 12/799,313

(22) Filed: Apr. 22, 2010

(65) Prior Publication Data

US 2010/0285910 A1 Nov. 11, 2010

Related U.S. Application Data

(63) Continuation-in-part of application No. 11/534,905, filed on Sep. 25, 2006, now Pat. No. 7,740,552.

(60) Provisional application No. 60/825,553, filed on Sep. 13, 2006, provisional application No. 61/319,294, filed on Mar. 31, 2010.

(51) Int. Cl.
*A63B 41/00* (2006.01)

(52) U.S. Cl. ..... 473/603; 473/594; 473/576

(58) Field of Classification Search ..... 473/593–597, 473/603, 599, 607, 609–611, 575, 576
See application file for complete search history.

(56) References Cited

U.S. PATENT DOCUMENTS

| | | | | |
|---|---|---|---|---|
| 1,595,441 | A | 8/1926 | Zenger | |
| 1,629,364 | A | 5/1927 | Scholly | |
| 2,210,024 | A * | 8/1940 | Cayo | 482/88 |
| 2,617,624 | A * | 11/1952 | Annis | 137/223 |
| 2,625,770 | A | 1/1953 | Steen et al. | |
| 3,693,972 | A * | 9/1972 | Minchin | 473/575 |
| 4,318,244 | A | 3/1982 | Magid et al. | |
| 4,687,458 | A * | 8/1987 | Handa | 446/222 |
| 4,834,382 | A | 5/1989 | Spector | |
| 4,915,669 | A | 4/1990 | Russell | |
| 4,917,381 | A | 4/1990 | Spector | |
| 4,963,117 | A | 10/1990 | Gualdoni | |
| 4,966,568 | A | 10/1990 | Nakamura et al. | |
| 4,986,540 | A | 1/1991 | Leslie | |
| 5,035,426 | A | 7/1991 | Spector | |
| 5,098,095 | A | 3/1992 | Weiss | |
| 5,098,329 | A | 3/1992 | Tseng | |
| 5,135,222 | A | 8/1992 | Spector | |
| 5,238,244 | A | 8/1993 | Cotter et al. | |
| 5,287,561 | A | 2/1994 | Spector | |
| 5,335,907 | A | 8/1994 | Spector | |
| 5,522,757 | A * | 6/1996 | Ostrowski | 446/220 |
| 5,577,732 | A | 11/1996 | Spector | |
| 5,597,339 | A | 1/1997 | Spector | |
| 5,813,896 | A | 9/1998 | Spector | |
| 6,053,829 | A | 4/2000 | Conley | |
| 6,093,077 | A | 7/2000 | Spector | |
| 6,572,499 | B2 | 6/2003 | Davies | |
| 7,740,552 | B2 * | 6/2010 | Spector | 473/603 |
| 2007/0060426 | A1 | 3/2007 | Maziarz et al. | |

* cited by examiner

*Primary Examiner* — Steven Wong
(74) *Attorney, Agent, or Firm* — Collard & Roe, P.C.

(57) ABSTRACT

A play ball comprising an outer casing having two adjacent openings, a vent and a balloon is provided. The outer casing is substantially non-porous. An uninflated balloon is inserted into the outer casing through an opening. During inflation of the balloon, air from within the outer casing is vented. A handle is attached to the outer casing through the adjacent openings in the casing. The handle is stretchable and can be in the form of an elastomeric band.

16 Claims, 4 Drawing Sheets

INFLATABLE PLAY BALL

CROSS-REFERENCE TO RELATED APPLICATIONS

This application claims the benefit of and priority to U.S. Provisional Patent Application Ser. No. 61/319,294 filed on Mar. 31, 2010, which is hereby incorporated by reference. This application is also a continuation-in-part of U.S. patent application Ser. No. 11/534,905 filed on Sep. 25, 2006, which claims priority from U.S. Provisional Patent Application Ser. No. 60/825,553 filed Sep. 13, 2006, this disclosure of which is herein incorporated by reference.

BACKGROUND OF THE INVENTION

This application generally relates to the field of balloon balls.

Balloon balls, for example, those sold under the trade name "Balzac", have a fabric casing over a balloon that is inflated to conform to the shape of the fabric coating. U.S. Pat. No. 4,834,382 discloses one such example. The balloon is inserted into an opening in the casing. Upon inflation, the elasticity of the balloon creates a much higher pressure than a typical ball with a non-expanding bladder. This is the reason why, unlike a football or basketball, no pump is required, and a balloon ball can be inflated by mouth.

Unlike a beach ball, which can be inflated by mouth, however, balloon balls have a higher number of pounds per square inch and bounce much higher. The balloons generally deflate over long periods of time and tend to sag after a day or two. This presents issues for retailers in displaying the products as well as the consumers who cannot leave the balloon balls inflated without deterioration of play value and the replacement of the balloon.

There exists a need, therefore, to provide balloon balls that are configured to readily permit re-inflation or replacement of the internal balloon.

SUMMARY OF THE INVENTION

Provided are improved balloon balls that readily permit re-inflation or replacement of the internal balloon as compared to conventional designs. In one aspect of the present invention, balloon balls are provided that comprise an outer casing having an opening for the insertion of a balloon and a second opening or vent to permit evacuation of air or gas from the outer casing while the balloon is being inflated. The outer casings are generally non-porous to air or gas. The vent can be a traditional inflation valve, such as that found on a beach ball. Other examples of vents include check-valves, mesh, holes, slits, flaps affixed with hook and loop fasteners over openings, and the like. The size and shape of the vent can be chosen to permit retrieval of balloon fragments should the need arise.

In accordance with one aspect of the present invention, an inflatable play ball includes an outer casing formed of a flexible material that is substantially non-porous which assumes a desired play ball configuration when expanded, the outer casing having a first opening and a second opening and a balloon formed of an elastomeric material, the balloon having a closeable opening and being inside the outer casing.

The ball is provided with an elastomeric handle that can be attached through an additional third opening that is provided adjacent the first or second opening. The handle is threaded through the two adjacent openings and secured around itself. This handle provides additional entertainment because it can be stretched and released by "punching" the ball with the user's fist while holding the handle. In one embodiment, the handle is an elastomer band. All of the openings can optionally include closure mechanisms.

In accordance with another aspect of the present invention, a method of inflating a play ball is provided. One aspect of the method includes the steps of: supplying an outer casing formed of a flexible material that is substantially non-porous, the outer casing comprising a first opening, a second opening forming a vent, and a third opening disposed adjacent one of the first and second openings; supplying a balloon formed of an elastomeric material and comprising a closeable opening; inserting the balloon in an uninflated state through the first opening in the outer casing and into the outer casing while leaving the closeable opening of the balloon outside of the outer casing; inflating the balloon by supplying air or a gas through the closeable opening; evacuating air from the outer casing through the second opening as the balloon inflates; closing the closeable opening upon inflation of the balloon; inserting the closeable opening within the outer casing; and attaching an elastomeric handle to the outer casing through the two adjacent openings. This causes a ball to assume a desired play ball configuration.

Another aspect of the present invention involves providing a kit that includes an outer casing formed of a flexible material that is substantially non-porous which assumes a desired play ball configuration when expanded, the outer casing having a first opening, a second opening or vent, and a third opening adjacent the first or second openings, and a balloon in its uninflated state formed of an elastomeric material adapted to be placed inside the outer casing through the first opening. An elastomeric handle is also provided that can be attached to the outer casing through the two adjacent openings in the outer casing.

DETAILED DESCRIPTION

Figure 2:
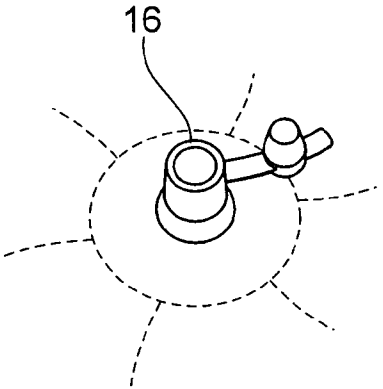
FIG. 2 illustrates an inflation valve.

In one aspect of the present invention, provided is an inflatable play ball that includes: an outer casing formed of a flexible material that is substantially non-porous to air which, when the outer casing is fully expanded, assumes a desired play ball configuration, the outer casing comprising an opening therein to permit insertion into the outer casing of a balloon in its uninflated state, a closure that is operable to substantially seal the opening during use of the ball, a second opening in the form of a vent to permit evacuation of air from the outer casing as the balloon is inflated, and an additional third opening adjacent the first opening or second opening to permit attachment of a handle; and the balloon formed of an elastomeric material, the balloon comprising a stem which initially projects through the first opening and is then outside of the outer casing to permit inflation of the balloon within the outer casing, after which, the stem is tied and inserted within the outer casing.

In another aspect, a method of inflating a play ball includes: supplying an outer casing formed of a flexible material that is substantially non-porous to air, the outer casing comprising a first opening, a second opening operating as a vent, and a third opening adjacent one of the first and second openings; supplying a balloon formed of an elastomeric material and comprising a stem; inserting the balloon in an uninflated state through the first opening and into the outer casing while leaving the stem outside of the outer casing; inflating the balloon by supplying air or a gas through the stem; evacuating air from the outer casing through the vent; tying the stem upon inflation of the balloon; inserting the stem within the outer casing; and attaching an elastomeric handle through the third opening and the adjacent one of the first and second openings, thereby forming a desired play ball configuration.

Referring now to FIGS. 1 to 5, there is illustrated an inflatable play ball and its components in accordance with the present invention. The ball comprises an outer casing 10 that is non-porous and an inflated balloon 12 which conforms to the shape of the outer casing. The outer casing 10 can also be substantially non-porous, for example, if stitching is used to hold various parts of the outer casing 10 together. When the outer casing 10 is expanded, as shown, a desired configuration of a play ball is provided. The casing can assume any shape and size as needed. For example, the play ball can be a football, a soccer ball or any other type of ball or configuration. The outer casing can also inflate to non-spherical, odd shapes, for example, the shape of a character. The outer casing 10 is substantially non-porous to air. The outer casing may be formed of many types of materials. In one embodiment, it may be desirable to use a polymeric plastic film, such as a polyvinyl chloride film used for beach balls. In another embodiment, it may be desirable to coat a fabric material to make the fabric material non-porous. The coating can be placed either within the outer casing 10 or on the exterior surface of the outer casing. The coating can be sprayed on. In accordance with one aspect of the present invention, the outer casing is a fabric and an impermeable membrane is attached or applied to the fabric. Of course, the impermeable membrane can be attached or applied to any flexible material.

An opening in the form of a vent 14 is provided in the outer casing 10 to permit evacuation of air from the outer casing 10 while the balloon is inflated within the casing. The vent can be a traditional inflation valve 16 such as that found on a beach ball, such as shown in FIG. 2. This is also referred to herein as a port and a plug combination. Other examples of vents include check-valves, mesh, holes, flaps affixed with hook and loop fasteners over openings, and the like. The vent 14 can be provided with a covering 15 as well, to help protect the integrity of the balloon during play.

Figure 3:
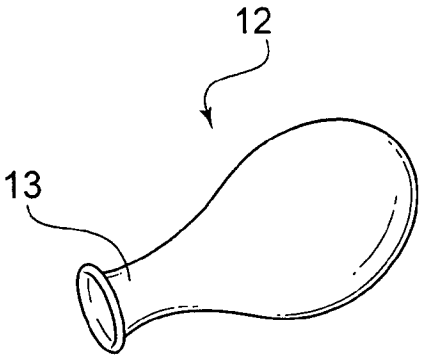
FIG. 3 illustrates an uninflated balloon which is inserted into an outer casing.
Figure 1:
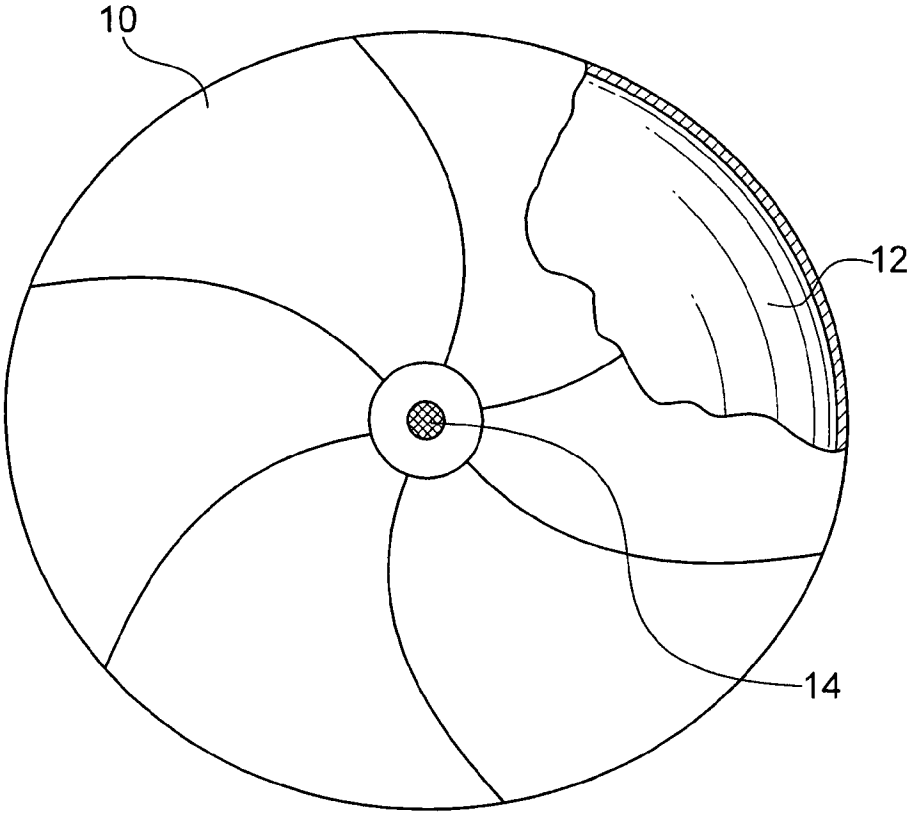
FIG. 1 illustrates a schematic of the play ball in accordance with one aspect of the present invention with a cut-away to show an inflated balloon inside an outer casing.
Figure 4:
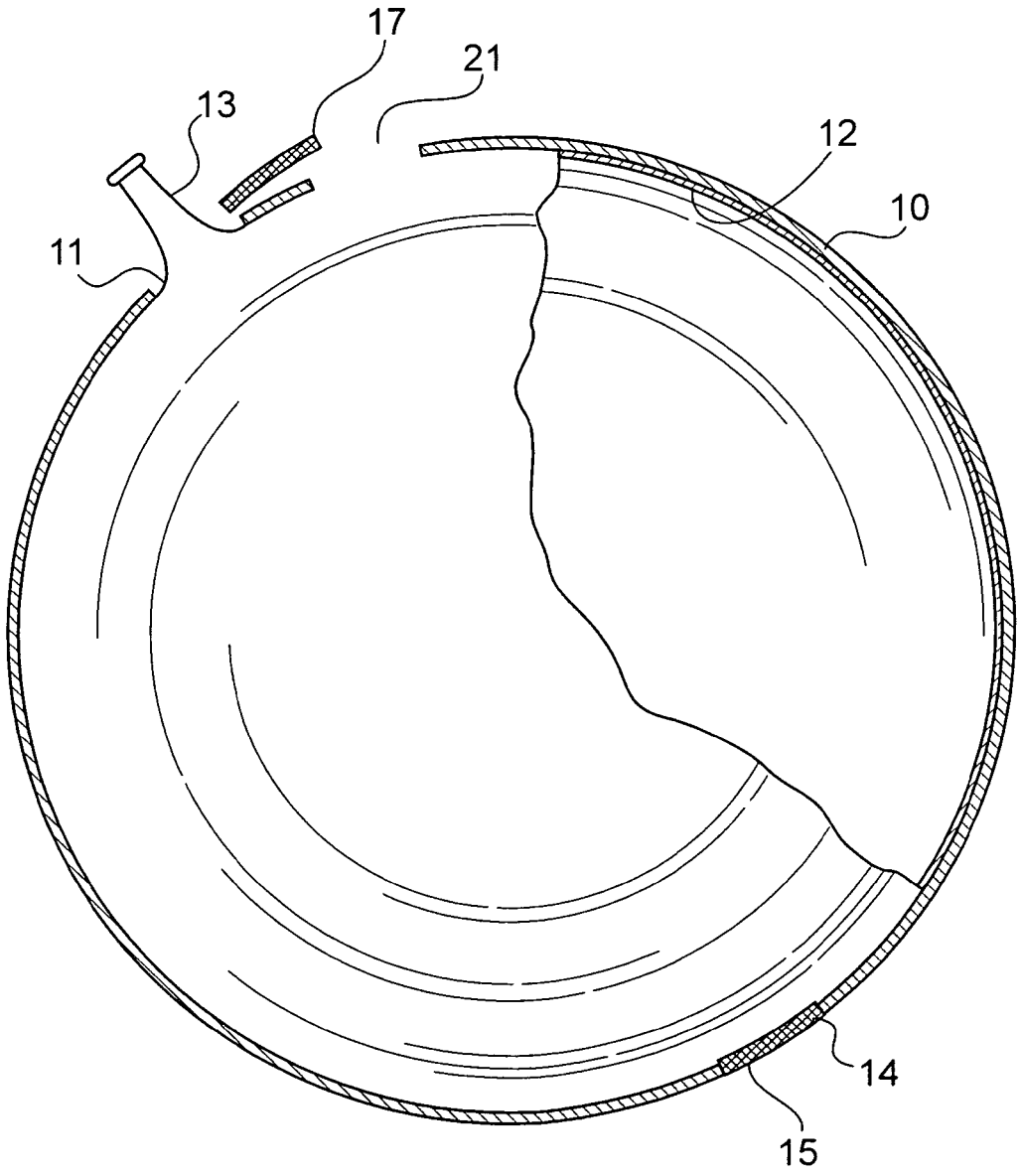
FIG. 4 illustrates another cross-sectional view of the play ball according to the invention.
Figure 5:
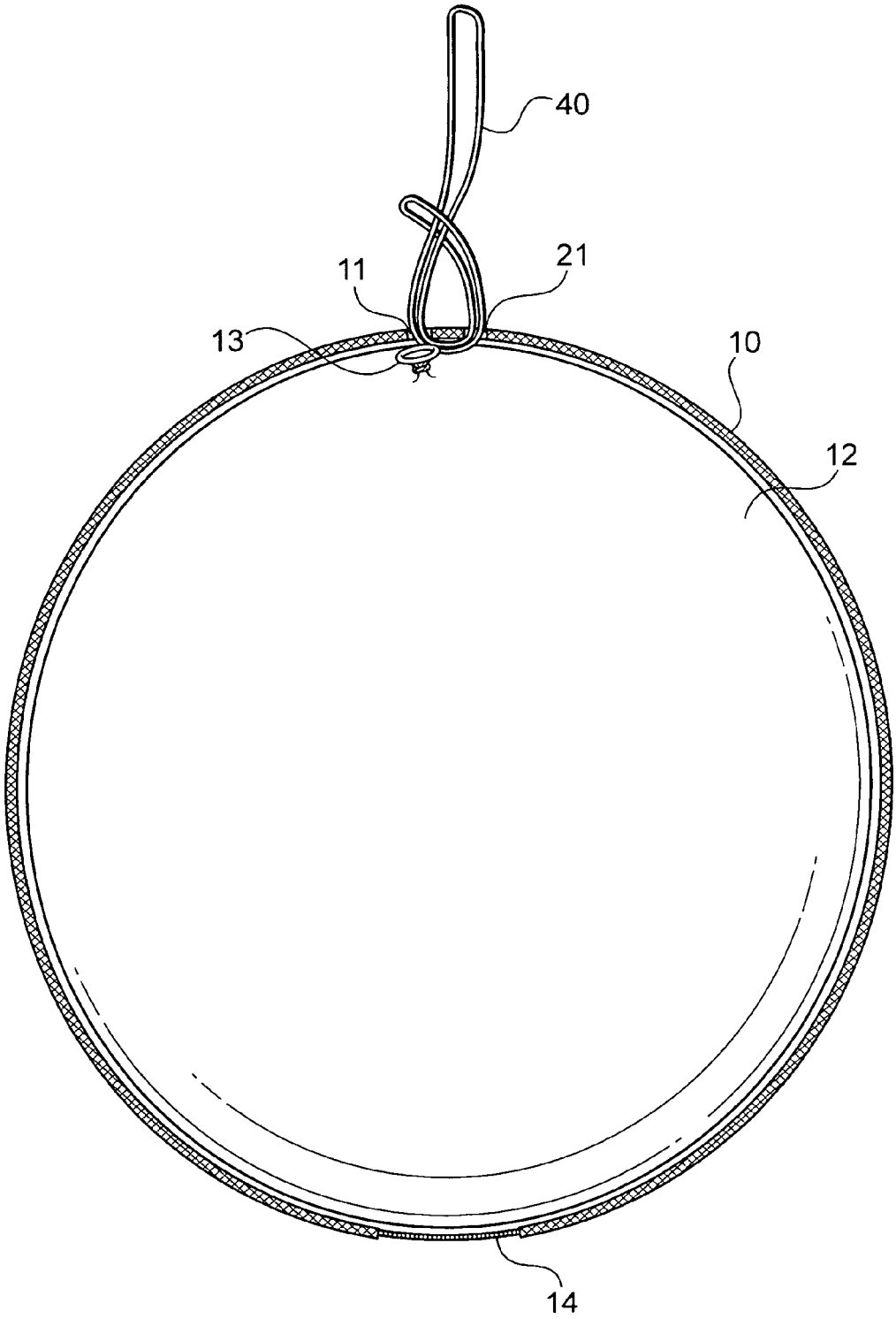
FIG. 5 illustrates a cross-sectional view of the play ball with the handle attached.

The balloon 12, in its uninflated state shown in FIG. 3, is formed of a thin elastomeric material having a stem 13 which initially projects through an opening 11, shown in FIG. 4, in the outer casing 10. The opening 11 can be a slit or any other suitable passage in the outer casing 10. In an embodiment of a beach ball, the opening can be an inflation valve sized to accommodate passage of an uninflated balloon. In another embodiment, the opening can be in the form of a slit such as a buttonhole. After the balloon has been inflated, the stem 13 can be tied off and inserted within the outer casing 10 through opening 11, as shown in FIG. 5. Generally, opening 11 can have a closure 17 to retain the balloon stem within the outer casing and substantially seal the opening during use of the ball when a handle is not inserted through opening 11. The closure over opening 11 can be a zipper, any type of valve, a plug, adhesive mesh or any other type of closure. Any of the closure mechanisms discussed herein can be used to close the openings 11 and 14 in the outer casing 10.

As the balloon 12 inflates, the second opening or vent 14, if closed, is opened and air from inside the outer casing 10 is evacuated from the outer casing 10. Once the balloon 12 is inflated, the stem 13 can be knotted and the second opening 14 closed with flap 15. The knotted stem 13 can be placed inside the outer casing 10 and the first opening 11 can also be closed via any of the previously described methods.

As shown in FIG. 5, an elastomeric handle 40 can be attached to outer casing 10 by threading it through openings 11, 21 and looping it around itself. This creates a punch-ball arrangement, that adds additional entertainment value to the ball. Handle 40 can be in any suitable form that is attachable to outer casing 10. In one embodiment, handle 40 is an elastomer band.

Figure 6:
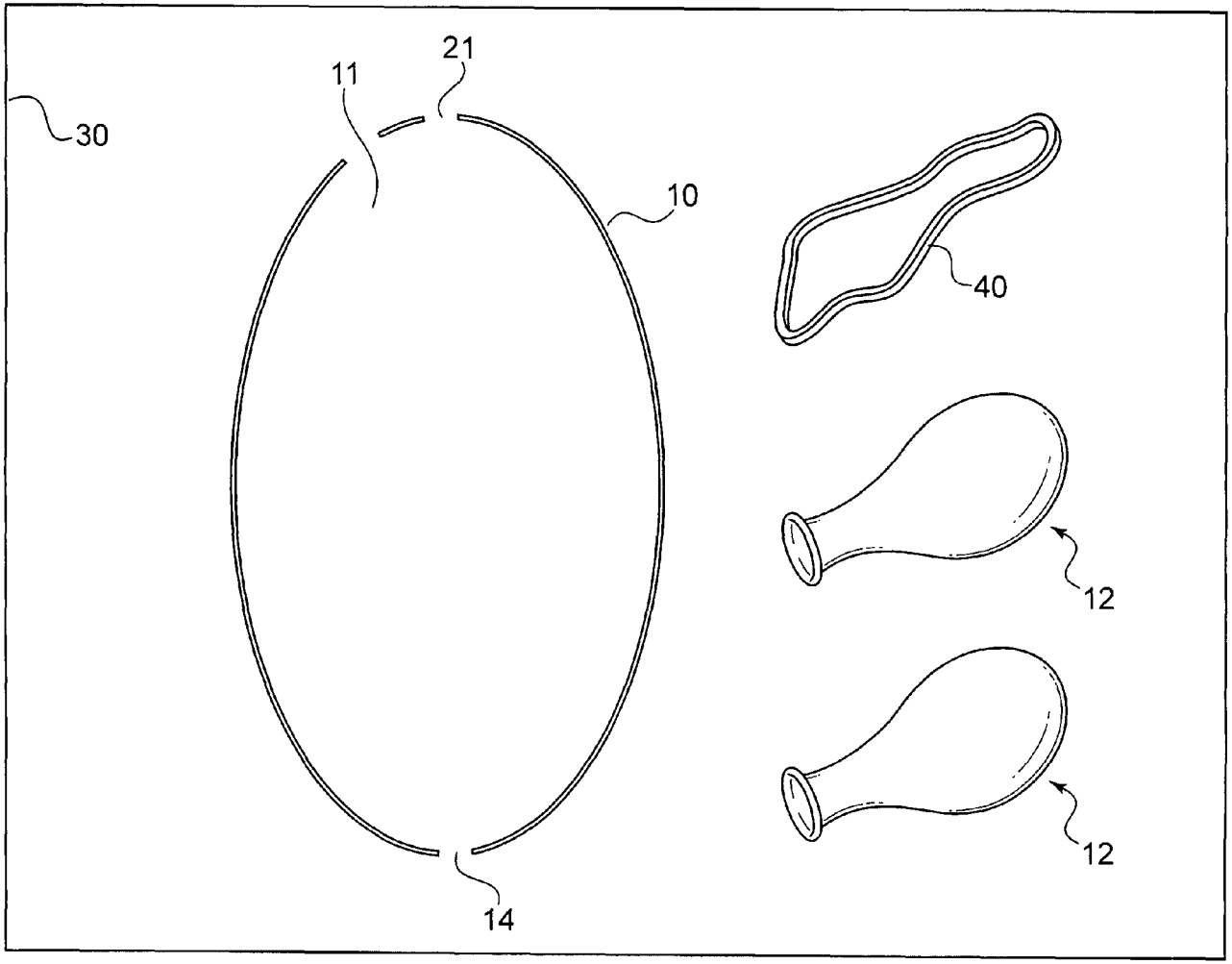
FIG. 6 is a schematic diagram of the kit according to the invention.

In accordance with another aspect of the present invention, as shown in FIG. 6, the outer casing 10, the balloon 12 and handle 40 are provided in a single package 30 for sale. Upon usage, the balloon 12 is inserted into the outer casing 10 through opening 11 and air is introduced into the balloon 12. Any air in the outer casing 10 is evacuated through the second opening 14 in the outer casing, and the balloon inflates to cause the outer casing 10 to assume a shape. Then, handle 40 is attached through openings 11 and 21.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. An inflatable play ball comprising:

an outer casing formed of a flexible material that is substantially non-porous which assumes a desired play ball configuration when expanded, the outer casing having a first opening, a second opening and a third opening, the third opening being disposed adjacent one of the first and second openings;

a removable balloon formed of an elastomeric material, the balloon having a closeable opening and being inside the outer casing; and an elastomeric handle secured to the outer casing through the third opening and the adjacent one of the first and second openings;

wherein when the balloon is inflated through the closeable opening in the balloon and through the first opening in the outer casing, air in the outer casing is evacuated through the second opening, and wherein the second opening in the outer casing includes a check-valve that permits evacuation of air from the outer casing as the balloon becomes inflated and prevents inflow of air into the outer casing during use of the ball.

2. The play ball of claim 1, wherein the closeable opening in the balloon is knotted.

3. The play ball of claim 1, wherein the flexible material includes a polymeric plastic film.

4. The play ball of claim 3, wherein the polymeric plastic film comprises polyvinyl chloride.

5. The play ball of claim 1, wherein the flexible material comprises a fabric material and a rubber coating adhered to the fabric material.

6. The play ball of claim 5, wherein the rubber coating is adhered to an outer surface of the outer casing.

7. The play ball of claim 5, wherein the rubber coating is adhered to an inner surface of the outer casing.

8. The play ball of claim 1, wherein the flexible material includes an impermeable membrane.

9. An inflatable play ball comprising:

an outer casing formed of a flexible material that is substantially non-porous which assumes a desired play ball configuration when expanded, the outer casing having a first opening, a second opening and a third opening, the third opening being disposed adjacent one of the first and second openings;

a removable balloon formed of an elastomeric material, the balloon having a closeable opening and being inside the outer casing; and an elastomeric handle secured to the outer casing through the third opening and the adjacent one of the first and second openings;

wherein when the balloon is inflated through the closeable opening in the balloon and through the first opening in the outer casing, air in the outer casing is evacuated through the second opening, and wherein the second opening in the outer casing includes a port and a plug that fits tightly into the port.

10. An inflatable play ball comprising:

an outer casing formed of a flexible material that is substantially non-porous which assumes a desired play ball configuration when expanded, the outer casing having a first opening, a second opening and a third opening, the third opening being disposed adjacent one of the first and second openings;

a removable balloon formed of an elastomeric material, the balloon having a closeable opening and being inside the outer casing; and an elastomeric handle secured to the outer casing through the third opening and the adjacent one of the first and second openings;

wherein when the balloon is inflated through the closeable opening in the balloon and through the first opening in the outer casing, air in the outer casing is evacuated through the second opening, and wherein the second opening in the outer casing includes a swath of mesh.

11. The play ball of claim 1, wherein at least one of the first, second and third openings in the casing has a closure element for closing the opening.

12. The play ball of claim 1, wherein the elastomeric handle comprises an elastomer band that is threaded through the third opening and the adjacent one of the first and second openings, and through a loop in the band to secure the handle to the outer casing.

13. A method of inflating a play ball comprising:

supplying an outer casing formed of a flexible material that is substantially non-porous, the outer casing comprising a first opening, a second opening, and a third opening that is disposed adjacent one of the first and second openings, wherein the second opening in the outer casing includes a check-valve that permits evacuation of air from the outer casing as the balloon becomes inflated and prevents inflow of air into the outer casing during use of the ball;

supplying a balloon formed of an elastomeric material and comprising a closeable opening;

inserting the balloon in an uninflated state through the first opening and into the outer casing while leaving the closeable opening outside of the outer casing;

inflating the balloon by supplying air or a gas through the closeable opening;

evacuating air from the outer casing through the second opening as the balloon inflates;

closing the closeable opening upon inflation of the balloon;

inserting the closeable opening within the outer casing; and securing an elastomeric handle to the outer casing through the third opening and through the adjacent one of the first and second openings in the outer casing;

thereby forming a desired play ball configuration.

14. A kit comprising:

an outer casing formed of a flexible material that is substantially non-porous which assumes a desired play ball configuration when expanded, the outer casing having a first opening, a second opening, and a third opening disposed adjacent one of the first and second openings, wherein the second opening in the outer casing includes a check-valve that permits evacuation of air from the outer casing as the balloon becomes inflated and prevents inflow of air into the outer casing during use of the ball;

a balloon in its uninflated state formed of an elastomeric material adapted to be placed inside the outer casing through the first opening; and an elastomeric handle that is adapted to be connected to the outer casing through the third opening and the adjacent one of the first and second openings in the outer casing.

15. The kit of claim 13, wherein the balloon is inside the outer casing.

16. The kit of claim 13, wherein the handle comprises an elastomer band.

* * * * *